US009777964B2

(12) United States Patent
Taras et al.

(10) Patent No.: US 9,777,964 B2
(45) Date of Patent: Oct. 3, 2017

(54) MICRO-PORT SHELL AND TUBE HEAT EXCHANGER

(75) Inventors: Michael F. Taras, Fayetteville, NY (US); Jack Leon Esformes, Jamesville, NY (US); Satyam Bendapudi, Syracuse, NY (US)

(73) Assignee: CARRIER CORPORATION, Farmington, CT (US)

( * ) Notice: Subject to any disclaimer, the term of this patent is extended or adjusted under 35 U.S.C. 154(b) by 245 days.

(21) Appl. No.: 14/129,439

(22) PCT Filed: Jun. 26, 2012

(86) PCT No.: PCT/US2012/044255

§ 371 (c)(1),
(2), (4) Date: Dec. 26, 2013

(87) PCT Pub. No.: WO2013/003375

PCT Pub. Date: Jan. 3, 2013

(65) Prior Publication Data

US 2014/0124171 A1 May 8, 2014

Related U.S. Application Data

(60) Provisional application No. 61/501,542, filed on Jun. 27, 2011.

(51) Int. Cl.

| | |
|---|---|
| ***F28D 7/16*** | (2006.01) |
| ***F28F 1/02*** | (2006.01) |
| *F28D 21/00* | (2006.01) |

(52) U.S. Cl.

CPC ..... *F28D 7/16* (2013.01); *F28D 7/1684* (2013.01); *F28F 1/022* (2013.01); *F28D 2021/0068* (2013.01); *F28F 2260/02* (2013.01)

(58) Field of Classification Search

CPC .. F28D 7/16; F28D 7/1684; F28D 2021/0068; F28F 1/022; F28F 2260/02

(Continued)

(56) References Cited

U.S. PATENT DOCUMENTS 4,836,276 A * 6/1989 Yamanaka ..... F01M 5/002 123/41.33

7,562,697 B2 7/2009 Gorbounov et al.

(Continued)

FOREIGN PATENT DOCUMENTS

| | | |
|---|---|---|
| CN | 201302409 | 9/2009 |
| CN | 201754042 | 3/2011 |

(Continued)

OTHER PUBLICATIONS

Office Action issued in Chinese Patent Application No. 20120032054.5, May 25, 2015, 11 pages.

(Continued)

*Primary Examiner* — Jianying Atkisson
*Assistant Examiner* — Raheena R Malik
(74) *Attorney, Agent, or Firm* — Cantor Colburn LLP

(57) ABSTRACT

A heat exchanger adapted to transmit a first fluid through an interior, having a tubular body receptive of a second fluid, whereby heat transfer occurs between the fluids is provided, the tubular body extending longitudinally through the interior, having a non-circular cross-section, and being formed to define microchannels extending longitudinally along the tubular body through which the second fluid is transmitted.

15 Claims, 2 Drawing Sheets

(58) Field of Classification Search
USPC ..... 165/157, 164
See application file for complete search history.

(56) References Cited

U.S. PATENT DOCUMENTS

| | | | | |
|---|---|---|---|---|
| 2003/0066636 | A1* | 4/2003 | Kawakubo | F25B 40/00 165/164 |
| 2004/0069477 | A1* | 4/2004 | Nishikawa | F28D 1/0391 165/175 |
| 2004/0099408 | A1 | 5/2004 | Shabtay et al. | |
| 2004/0261986 | A1* | 12/2004 | Insalaco | F28F 1/022 165/181 |
| 2006/0102321 | A1* | 5/2006 | Shincho | C01B 3/34 165/81 |
| 2006/0151160 | A1* | 7/2006 | Take | F25B 39/00 165/177 |
| 2006/0254310 | A1* | 11/2006 | Kamsma | F25B 39/04 62/509 |
| 2006/0254757 | A1* | 11/2006 | Kamsma | F25B 40/00 165/163 |
| 2007/0023172 | A1* | 2/2007 | Obrist | F28D 1/0246 165/153 |
| 2008/0223560 | A1 | 9/2008 | Hoenisch et al. | |
| 2008/0277095 | A1 | 11/2008 | Zhai | |
| 2009/0166016 | A1* | 7/2009 | Hu | F28D 1/0443 165/151 |
| 2010/0012305 | A1 | 1/2010 | Taras et al. | |
| 2010/0012307 | A1 | 1/2010 | Taras et al. | |
| 2010/0025019 | A1 | 2/2010 | Sakamoto et al. | |
| 2010/0071868 | A1 | 3/2010 | Reifel et al. | |
| 2010/0147500 | A1* | 6/2010 | Minami | B23K 1/0012 165/173 |
| 2010/0170669 | A1 | 7/2010 | Jaworowski | |
| 2010/0175854 | A1 | 7/2010 | Gratton | |
| 2011/0017438 | A1 | 1/2011 | Huazhao et al. | |
| 2011/0146594 | A1* | 6/2011 | Smelcer | F24H 1/287 122/18.3 |
| 2011/0308778 | A1* | 12/2011 | Tsuda | F02M 26/32 165/157 |
| 2012/0151950 | A1* | 6/2012 | Jagusztyn | F28D 7/1684 62/228.1 |

FOREIGN PATENT DOCUMENTS

| | | | |
|---|---|---|---|
| EP | 1389721 | A1 | 2/2004 |
| EP | 2159514 | A2 | 3/2010 |
| WO | 2008150434 | A1 | 12/2008 |
| WO | 2009013179 | A2 | 1/2009 |

OTHER PUBLICATIONS

International Search Report dated Sep. 25, 2012 issued in PCT/US2012/044255 filed Jun. 26, 2012, 6 pages.

Written Opinion dated Sep. 25, 2012 issued in PCT/US2012/044255 filed Jun. 26, 2012, 9 pages.

Chinese Second Office Action for application CN 2012800320545, dated Nov. 16, 2015, 10 pages.

T. Kuppan, "Heat Exchanger Design Handbook (Author: T. Kuppan, Translator: Qian Songwen, Liao Jinyu, etc.,)" pp. 303-304, China Petrochemical Press, Edition 1, 2004, 2 pages.

* cited by examiner

MICRO-PORT SHELL AND TUBE HEAT EXCHANGER

CROSS REFERENCE TO RELATED APPLICATION

This application is a National Stage Application of PCT/US2012/044255 filed Jun. 26, 2013, which claims priority of U.S. Provisional Application No. 61/501,542 filed Jun. 27, 2011.

BACKGROUND OF THE INVENTION

The subject matter disclosed herein relates to a heat exchanger and, more particularly, to a shell and tube heat exchanger.

Heating and cooling systems, such as HVAC and refrigeration systems, typically employ various types of heat exchangers to provide heating and cooling. These heat exchangers often include shell and tube or tube in tube heat exchangers. In each case, heat transfer usually occurs between fluids that are directed to flow in close proximity to one another and in a closely coupled heat transfer interaction with one another.

For example, in a shell and tube heat exchanger, a shell forms an exterior surface of a vessel into which refrigerant vapor is introduced. Water is then directed through water tubes extending through the vessel such that heat transfer occurs between the refrigerant and the water. In another example, refrigerant may be directed through the tubes, while water or other heat transfer media, such as ethylene glycol or propylene glycol, is directed through the space between the tubes and the heat exchanger outer shell.

Shell and tube heat exchangers typically represent about 50% of the cost of water cooled chillers and often determine the required refrigerant amount and the unit footprint, both of which tend to change over time in response to constantly rising energy efficiency demands that typically increase the size limitations and cost of shell and tube heat exchangers.

BRIEF DESCRIPTION OF THE INVENTION

According to one aspect of the invention, a tubular body of a heat exchanger is provided. The heat exchanger is adapted to transmit a first fluid through an interior, the tubular body being receptive of a second fluid, whereby heat transfer occurs between the first and second fluids. The tubular body extends longitudinally through the interior of the heat exchanger, has a non-circular cross-section, and is formed to define microchannels extending longitudinally through the tubular body through which the second fluid is transmitted.

According to another aspect of the invention, a heat exchanger is provided and includes a shell defining an interior, manifolds coupled to the shell by which a first fluid is communicated within the interior, and a tubular body disposed within the interior to transmit a second fluid therethrough, whereby heat transfer occurs between the first and second fluids. The tubular body extends longitudinally through the interior, has a non-circular cross-section, and is formed to define microchannels extending longitudinally through the tubular body through which the second fluid is transmitted.

According to yet another aspect of the invention, a heat exchanger is provided and includes a shell defining an interior, manifolds coupled to the shell by which a first fluid is communicated within the interior, and first and second tubular bodies to transmit a second fluid through the interior, whereby heat transfer occurs between the first and second fluids, wherein each of the first and second tubular bodies extends longitudinally through the interior of the heat exchanger, has a non-circular cross-section, and is formed to define microchannels extending longitudinally through the tubular body through which the second fluid is transmitted.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Heat exchanger effectiveness has become one of the foremost driving forces in meeting constantly increasing overall system efficiency demands and reducing carbon dioxide emissions, as prescribed by the industry requirements and governmental regulations. Superior heat exchanger performance ultimately leads to footprint, weight and material content reductions.

In accordance with aspects of the present invention, the heat exchanger construction is a microchannel heat exchanger ("MCHX") for gas-to-liquid, liquid-to-liquid and gas-to-gas applications. In the gas-to-liquid case, for example, air is directed outside of the heat exchanger tubes and refrigerant or other coolant is directed through the tubes. The MCHX design allows for more compact configurations, enhanced performance, refrigerant charge reduction and improved structural rigidity.

Figure 1:
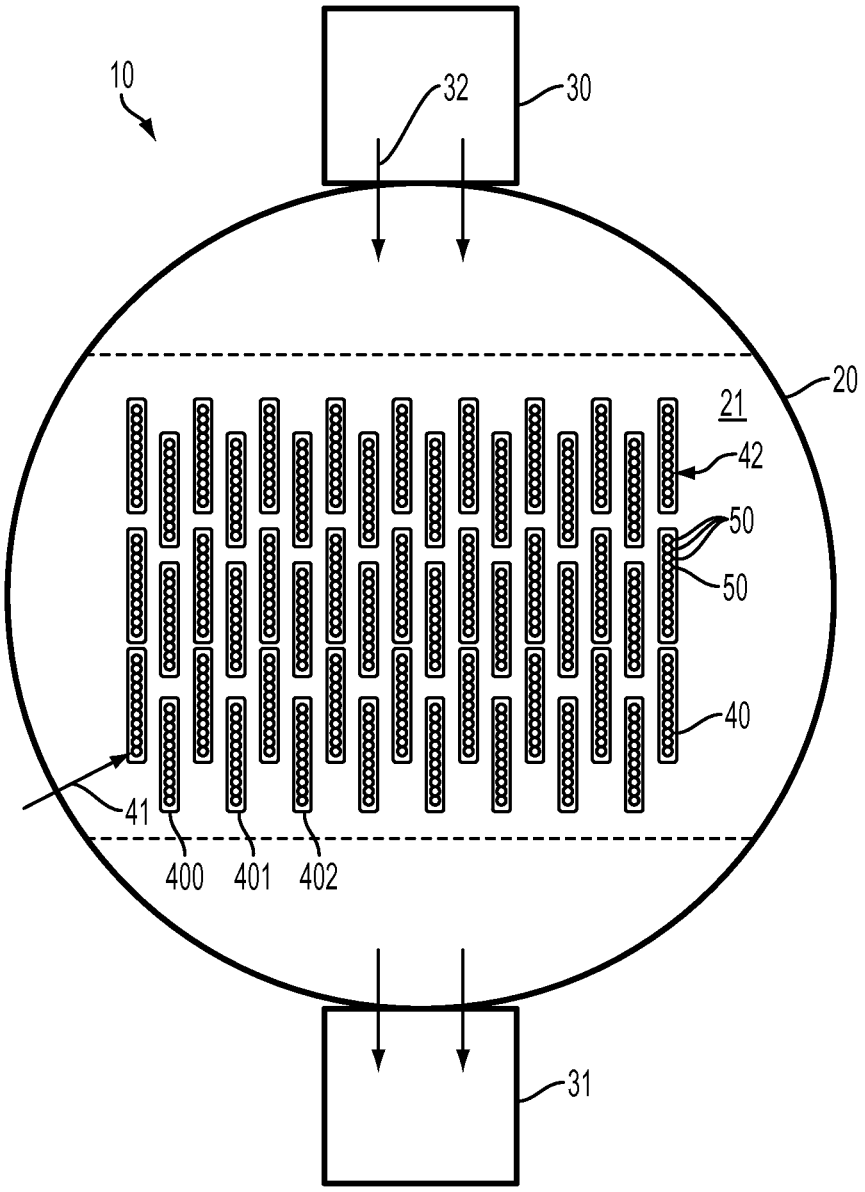
FIG. 1 is a cross-sectional view of a heat exchanger.

With reference to FIG. 1, a heat exchanger 10 is provided. The heat exchanger 10 includes a shell 20 defining an interior 21 therein, inlet/outlet manifolds 30, 31 fluidly coupled to the shell 20, by which a first fluid 32 is communicated with the interior 21 of the shell 20, and a tubular body 40. The tubular body 40 is configured to transmit a second fluid 41 through the interior 21 of the shell 20, in particular, within tubular bodies 40. As such, heat transfer occurs between the first and second fluids 32 and 41.

More specifically, the tubular body 40 extends longitudinally through the interior 21 of the shell 20 in one or more passes, has a non-circular cross-section 42, and is formed to define microchannels 50. The non-circular cross-section 42 may be elongated, oval, or rectangular. The microchannels 50 are arranged in a side-by-side configuration within the non-circular cross-section 42 and are bored longitudinally through the tubular body 40. The microchannels 50 provide pathways within the tubular body 40 through which the second fluid 41 is transmitted. For example, as shown in FIG. 1, the non-circular cross-section 42 is predominantly a rectangular shape with rounded corners, the microchannels 50 are aligned along a center-line thereof. If the microchannels 50 are small enough relative to the tubular body 40, the microchannels 50 may be arrayed in either an in-line or staggered matrix arrangement along the center-line of the cross-section 42. It has to be understood that although the microchannels 50 are shown as having a circular cross-section, they may have any non-circular or other polygonal cross-sectional shape, including but not limited to rectangular, trapezoidal, or triangular shapes, each of which are within the scope of this invention.

In accordance with certain embodiments, water or glycol may be directed through the microchannels 50 as the second fluid 41, with refrigerant, such as low pressure refrigerants R134a or R1234yf, provided in the interior 21 as the first fluid 32 for condensing or evaporating. Alternatively, refrigerant, such as high pressure refrigerants R410A or $CO_2$, may be directed through the microchannels 50 as the second fluid 41, while coolant is directed through the interior 21 as the first fluid 32.

The tubular body 40 may include copper as a base metal with aluminum and/or plastic added. Alternatively, the tubular body 40 may be formed of aluminum, plastic, or other materials. That is, although the tubular body 40 can be made from copper material, less expensive aluminum or plastic material would achieve further cost and weight savings. Where aluminum is used, a brazing furnace operation can be employed for the production of the tubular body 40 or a bundle thereof for later insertion into the shell 20. With plastic materials, diffusion bonding or any other known method can be used to rigidly assemble the tubular body 40 or the bundle thereof.

Figure 2:
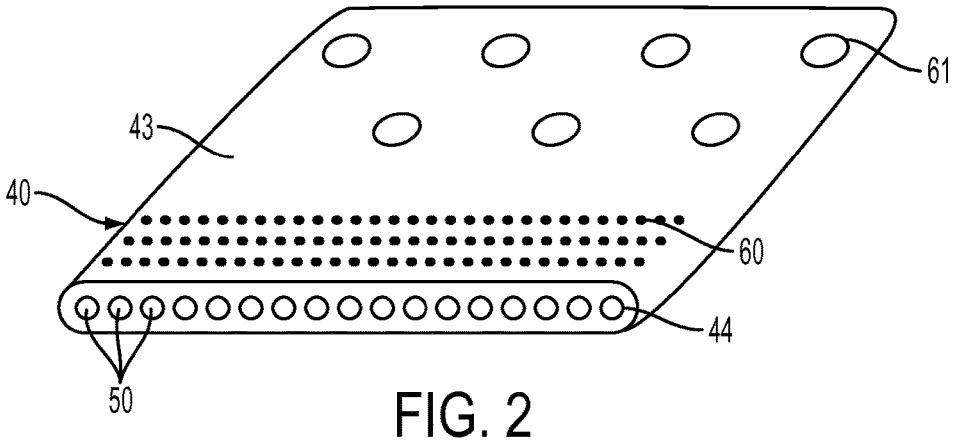
FIG. 2 is a perspective view of a portion of a tubular member of the heat exchanger of FIG. 1.
Figure 3:
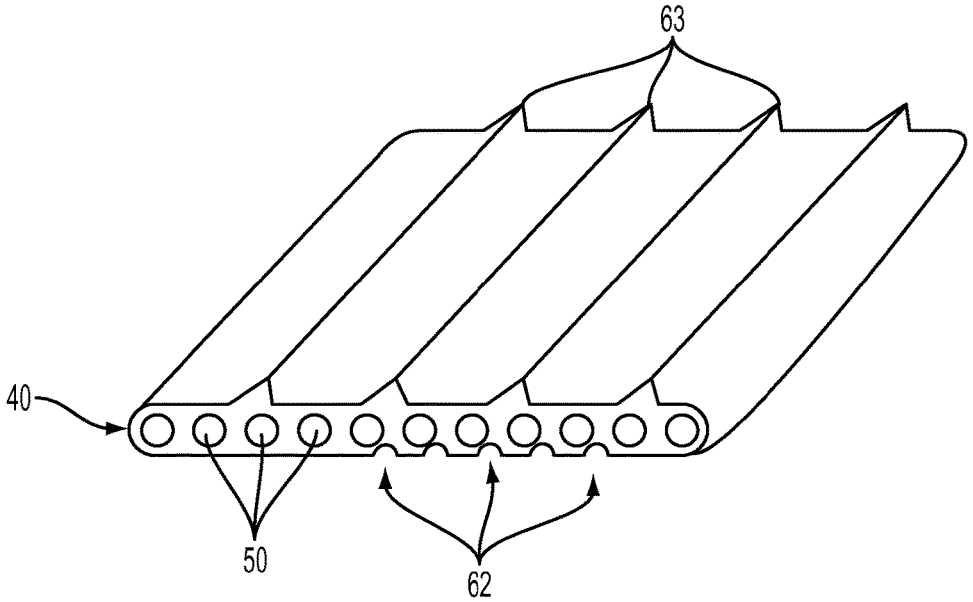
FIG. 3 is a perspective view of a portion of a tubular member of the heat exchanger of FIG. 1.

With reference to FIGS. 2 and 3, the tubular body 40 includes an exterior surface 43 to which a coating material is applied in order to promote one of filmwise and dropwise condensation and to improve heat transfer characteristics. Tubular body 40 also includes interior surfaces 44. The exterior surface 43 and the interior surfaces 44 may include one or more of porous features 60, indentations 61, grooves 62 and fins 63. The porous features 60 may be formed by metal being sprayed onto the exterior and/or interior surfaces 43, 44. Indentations 61 can be made to promote nucleation. The grooves 62 and the fins 63 can be integrated in the exterior surface 43 or interior surfaces 44 of the tubular body 40 during extrusion processes or secondary operations, and can be longitudinally or laterally oriented relative to the tubular body 40.

Referring back to FIG. 1, it is to be understood that the tubular body 40 may be provided as a plurality of tubular bodies 40, with each tubular body 40 being constructed substantially as described above but not necessarily similarly with respect to one another. For example, first and second tubular bodies 400, 401 may each have an elongate cross-section 42 and may be oriented such that the elongation is aligned substantially vertically or such that the elongation of one or both is angled with respect to the vertical direction. Where both are angled, the angling may be similar or different. In any case, the vertical or nearly vertical orientation aids in drainage of condensate.

Similarly, first and second tubular bodies 400, 401 may each include exterior and interior surfaces 43, 44 having different porous features 60, indentations 61, grooves 62 and fins 63. The first and second tubular bodies 400, 401 may have similar or different sizes. Further, distances between the first and second tubular bodies 400, 401 and between the second tubular body 401 and a third tubular body 402 may be similar or different. Similarly, distances between microchannels within tubular bodies 400, 401 and 402 may be different, depending on the location of each tubular body within the shell 20. In some cases, the relative position of tubular bodies 40 may be set so as to decrease a footprint of the heat exchanger 10 and/or to prevent or reduce inundation.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat exchanger, comprising:

a shell defining an interior;

manifolds coupled to the shell by which a first fluid is communicated with the interior; and first and second tubular bodies to transmit a second fluid through the interior whereby heat transfer occurs between the first and second fluids, wherein each of the first and second tubular bodies:

extends longitudinally through the interior of the heat exchanger, has a non-circular cross-section, and is formed to define discrete microchannels extending longitudinally through the tubular body through which the second fluid is transmitted;

wherein the spacing between the discrete microchannels disposed in the first tubular body is different from the spacing between the discrete microchannels disposed in the second tubular body.

2. The heat exchanger according to claim 1, wherein the first tubular body comprises copper alloy, aluminum alloy or plastic.

3. The heat exchanger according to claim 1, wherein a coating material is applied to an exterior surface of the first tubular body to promote one of filmwise and dropwise condensation.

4. The heat exchanger according to claim 1, wherein the first fluid comprises water or glycol solution and the second fluid comprises refrigerant.

5. The heat exchanger according to claim 1, wherein the first fluid comprises refrigerant and the second fluid comprises water or glycol solution.

6. The heat exchanger according to claim 1, wherein the first tubular body has an elongate cross-section, the microchannels being defined in an elongate arrangement along the elongate cross-section.

7. The heat exchanger according to claim 1, wherein any one or more of the microchannels have a circular cross-section.

8. The heat exchanger according to claim 1, wherein the first tubular body comprises: one or more of porous features, indentations, grooves and fins formed on at least one of an interior surface and exterior surface thereof.

9. The heat exchanger according to claim 1, wherein the first and second tubular bodies each have an elongate cross-section and are aligned substantially vertically relative to each other.

10. The heat exchanger according to claim 9, wherein the first and second tubular bodies are disposed at different angles relative to each other.

11. The heat exchanger according to claim 1, wherein the first and second tubular bodies each comprise microchannels of different size and cross-sectional shape.

12. The heat exchanger according to claim 11, wherein the cross-sectional shape is polygonal or non-circular.

13. The heat exchanger according to claim 1, wherein the first and second tubular bodies each comprise one or more porosities, indentations, grooves and fins on at least one of an exterior and interior surface thereof.

14. The heat exchanger according to claim 1, wherein the first and second tubular bodies have different sizes.

15. The heat exchanger according to claim 1, comprising a plurality of tubular bodies, wherein the tubular bodies are disposed at different distances from each other or at different angles relative to each other.

* * * * *